US005872542A

United States Patent [19]

Simons et al.

[11] Patent Number: 5,872,542

[45] Date of Patent: Feb. 16, 1999

[54] OPTICALLY TRANSPARENT MICROSTRIP PATCH AND SLOT ANTENNAS

[75] Inventors: Rainee Simons, North Olmsted, Ohio; Richard Q. Lee, Ann Arbor, Mich.

[73] Assignee: Federal Data Corporation, Brookpark, Ohio

[21] Appl. No.: 23,096

[22] Filed: Feb. 13, 1998

[51] Int. Cl.[6] ..... H01Q 1/38

[52] U.S. Cl. ..... 343/700 MS; 343/767; 343/769

[58] Field of Search ..... 343/700 MS, 846, 343/848, 767, 769; H01Q 1/38, 13/10, 13/12

[56] References Cited

U.S. PATENT DOCUMENTS

| | | | |
|---|---|---|---|
| Re. 29,911 | 2/1979 | Munson | 343/700 MS |
| 4,170,013 | 10/1979 | Black | 343/700 MS |
| 4,197,544 | 4/1980 | Kaloi | 343/700 MS |
| 4,746,925 | 5/1988 | Toriyama | 343/713 |
| 4,768,037 | 8/1988 | Inaba et al. | 343/713 |
| 4,849,766 | 7/1989 | Inaba et al. | 343/713 |
| 4,864,314 | 9/1989 | Bond | 343/700 MS |
| 4,864,316 | 9/1989 | Kaoru et al. | 343/704 |
| 5,083,135 | 1/1992 | Nagy et al. | 343/713 |
| 5,528,314 | 6/1996 | Nagy et al. | 343/713 |
| 5,598,168 | 1/1997 | Evans et al. | 343/700 MS |
| 5,767,808 | 6/1998 | Robbins et al. | 343/700 MS |

OTHER PUBLICATIONS

"Transparent Conductors–A status Review", by K.L. Chopra, S. Major and D.K. Pandya, vol. 102(1983), pp. 1–46.

*Primary Examiner*—Hoanganh Le

*Attorney, Agent, or Firm*—Tarolli, Sundheim, Covell, Tummino & Szabo

[57] ABSTRACT

An antenna (10, 110, 210) comprising a ground layer (30, 130, 230), a feed layer (50, 150, 250), an antenna layer (40, 140, 240) and a transparent dielectric substrate (20, 120, 220) interposed between two of the layers (30 and 40, 140 and 150, 230 and 250). An electromagnetic field is produced between the ground layer (30, 130, 230) and the antenna layer (40, 140, 240) when the feed and ground layers (50 and 30, 150 and 130, 250 and 230) are exposed to a microwave frequency above 3,000 megahertz for transmission and when the antenna and ground layers (40 and 30, 140 and 130, 240 and 230) are exposed to a microwave frequency above 3,000 megahertz, for reception. The ground layer (30, 130, 230), feed layer (50, 150, 250) and antenna layer (40, 140, 240) are made of an optically transparent and electrically conductive material. About 30% of the visible light impinging on the antenna (10, 110, 210) passes through the antenna.

20 Claims, 2 Drawing Sheets

OPTICALLY TRANSPARENT MICROSTRIP PATCH AND SLOT ANTENNAS

TECHNICAL FIELD

The present invention relates to an antenna for receiving or transmitting electromagnetic energy at or above microwave frequencies from or to a free space. The present invention more particularly relates to microstrip patch or slot antennas.

BACKGROUND OF THE INVENTION

A microstrip antenna typically comprises a dielectric substrate having a ground layer, a patch layer spaced apart from the ground layer, and a feed layer electromagnetically communicating with the patch layer. The ground layer, patch layer, and the feed layer are made of an electrically conducting material such as copper. It is desirable to provide a patch or slot antenna, which is optically transparent. It is also desirable to provide an antenna that operates at or above microwave frequencies.

SUMMARY OF THE INVENTION

The antenna of the present invention comprises a ground layer, a feed element, an antenna layer, and a transparent dielectric substrate interposed between at least two of the layers. An electromagnetic field is produced between the ground layer and the antenna layer when the feed and ground layers are exposed to electromagnetic energy at a microwave frequency above about 3,000 megahertz for transmission and when the antenna and ground layers are exposed to electromagnetic energy at a microwave frequency above about 3,000 megahertz, for reception. The ground and antenna layers are made of a substantially optically transparent and electrically conductive material. The antenna allows at least about 30% of the visible light impinging on the antenna to pass through it.

BRIEF DESCRIPTION OF THE DRAWINGS

The foregoing and other features of the invention will become more apparent to one skilled in the art upon consideration of the following description of the invention and the accompanying drawings in which.

DESCRIPTION OF PREFERRED EMBODIMENTS

Figure 1:
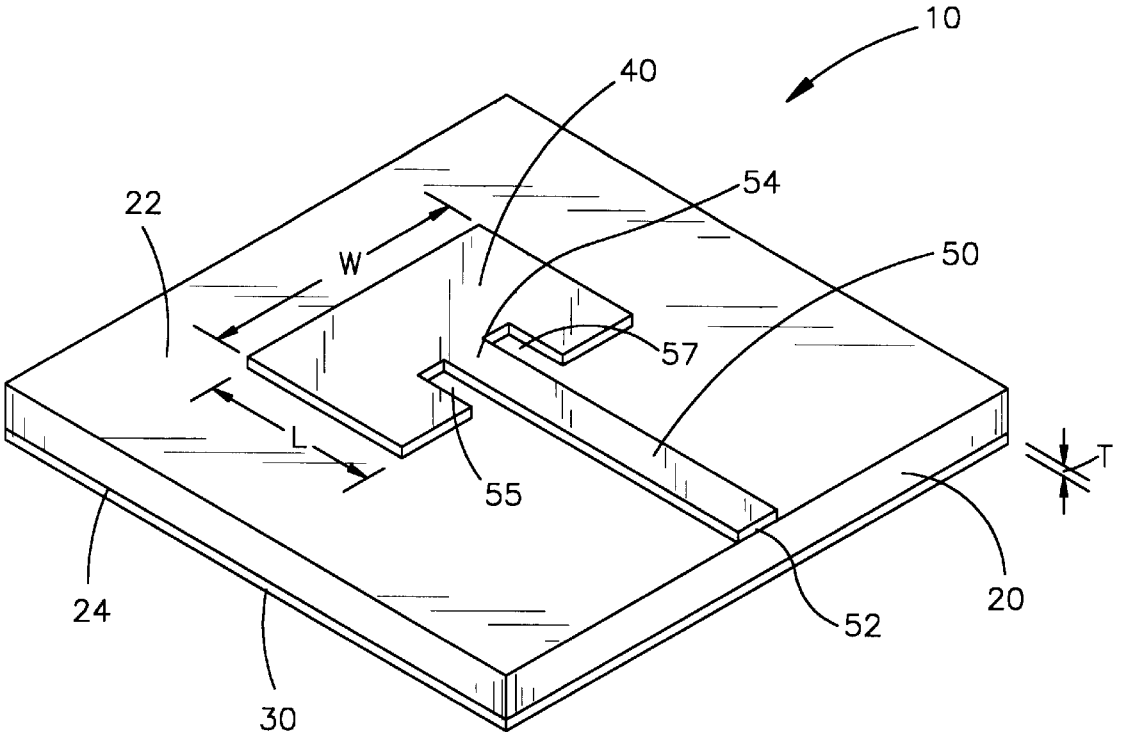
FIG. 1 is a perspective view of an antenna in accordance with a first embodiment of the present invention.

FIG. 1 illustrates a patch antenna 10 constructed in accordance with a first embodiment of the present invention. The antenna 10 is capable of transmitting or receiving high frequency signals, such as a microwave frequency above 3,000 MHz, to or from a free space. The antenna 10 includes a dielectric substrate 20 having substantially planar and parallel upper and lower surfaces 22 and 24, respectively. The substrate 20 is substantially transparent. The substrate 20 can be made of glass, laminated glass, polyester, Plexiglas®, which is manufactured by Rohm and Haas, Co., of Philadelphia, Pa., or any other generally rigid transparent material. Preferably, the substrate 20 is made of glass.

The antenna 10 has a ground layer 30 adhered to at least a substantial portion of the lower surface 24 of the substrate 20. The ground layer 30 preferably covers the entire lower surface 24 of the substrate 20. The ground layer 30 has a first thickness T, suitably between about 1000 and 1200 Angstroms and preferably about 1100 Angstroms, and is made of an optically transparent and electrically conducting coating material. It will be appreciated that as the thickness increases beyond about 1200 Angstroms, the transparency reduces.

By being optically transparent, it is meant that the coating material is substantially transparent to visible and infrared light, passing at least about 30% of such light. By being electrically conducting, it is meant that the surface resistance of the coating material is less than about 10 ohms/square and preferably about 5 ohms/square or less. If the surface resistance is higher, as with many conventional materials, it has been determined that a microwave signal, suitably above 3000 MHz, may be significantly attenuated and antenna efficiency may be decreased.

The electrically conducting and optically transparent coating material is preferably ECI-969®, which is manufactured by Evaporated Coatings Inc., of Willow Grove, Pa. Other suitable electrically conducting and optically transparent coating materials include AgHT coatings, which are manufactured by Courtaulds Performance Films, of Canoga Park, Calif., indium tin oxide, cadmium tin oxide, zinc oxide as well as any other electrically conducting and optically transparent coating material.

The antenna 10 further includes an antenna layer 40 adhered to a portion of the upper surface 22 of the substrate 20, with the antenna layer 40 being spaced from ground layer 30 a predetermined distance generally equal to the thickness of substrate 20. The antenna layer 40 preferably has a thickness approximately equal to the first thickness T of the ground layer 30. The antenna layer 40 is made of an electrically conducting and optically transparent coating material and is preferably made of the same electrically conducting and optically transparent coating material as the ground layer 30.

The shape of the antenna layer 40 can be square, elliptical, circular or other shapes, although preferably rectangular, as shown in FIG. 1. It is also preferable that the surface area of the antenna layer 40 is less than the surface area of the ground layer 30. In the embodiment shown in FIG. 1, the length L of the antenna layer 40 should be about 0.5 or less of one wavelength of the carrier signal in the substrate and the width W of the antenna layer may be less than, greater than or equal to the length L of the antenna layer, and suitably about 1.5 L. Thus, the shape and size of the antenna layer 40 is determined in part by the frequencies for which the antenna will be used as well as by the electrical properties of the material selected for use as the substrate 20.

In the preferred embodiment of FIG. 1, the antenna also includes a feed element, which is illustrated as a narrow feed layer 50 adhered to the upper surface 22 of the substrate 20. The feed layer 50 has first and second ends 52 and 54 that extend transversely from an edge of the antenna layer 40 to an edge of the upper surface of the substrate. The second end 54 can extend into the interior of the antenna layer 40 as an inset of microstrip feed to optimize the impedance match. As shown in FIG. 1, the inset of feed layer 50 is further defined by a pair of substantially parallel channels 55 and 57 formed on opposed sides of feed layer 50 and extending a predetermined distance into antenna layer 40. The feed layer 50 is made of an electrically conducting and optically transparent coating material and is preferably made of the same electrically conducting optically transparent coating material as the ground and antenna layers 30 and 40, respectively. The feed layer 50 has a thickness approximately equal to the first thickness T of the ground layer 30. Thus, the ground layer 30, the antenna layer 40 and the feed layer 50 are preferably all about the same thickness.

The feed layer 50 communicates electromagnetic energy to or from the antenna layer 40. It should be understood that the elongated feed layer 50 could be eliminated in which case the antenna layer 40 of the antenna 10 could be excited by another type of feed element including another type of direct coupling, such a conventional probe (not shown) or by an electromagnetic coupling (not shown).

The antenna 10 may be manufactured, such as via lithography, by depositing a layer of an appropriate electrically conducting and optically transparent coating material of substantially uniform thickness on a substantial portion, and preferably the entire lower surface 24 of the substrate 20. A layer of conventional photoresist may be applied to the upper surface 22 of the substrate 20. The layer of photoresist should cover all of the upper surface 22 of the substrate 20, except for the portion of the upper surface to be covered by the antenna layer 40 and the feed layer 50. It will be understood that other types of direct feed or electromagnetic feed elements may be used, such as those set forth herein. A layer of the electrically conducting and optically transparent coating material of substantially uniform thickness is adhered to the area of the upper surface 22 of the substrate 20 that is not covered by the photoresist. In order to complete manufacture of the antenna 10, the photoresist is then removed by any conventional technique, such as by submersing the substrate 20 in a conventional liquid photoresist remover. The antenna 10, in its operational condition, is optically transparent in that it enables passage of at least about 30% of the visible light impinging on the antenna 10.

Figure 2:
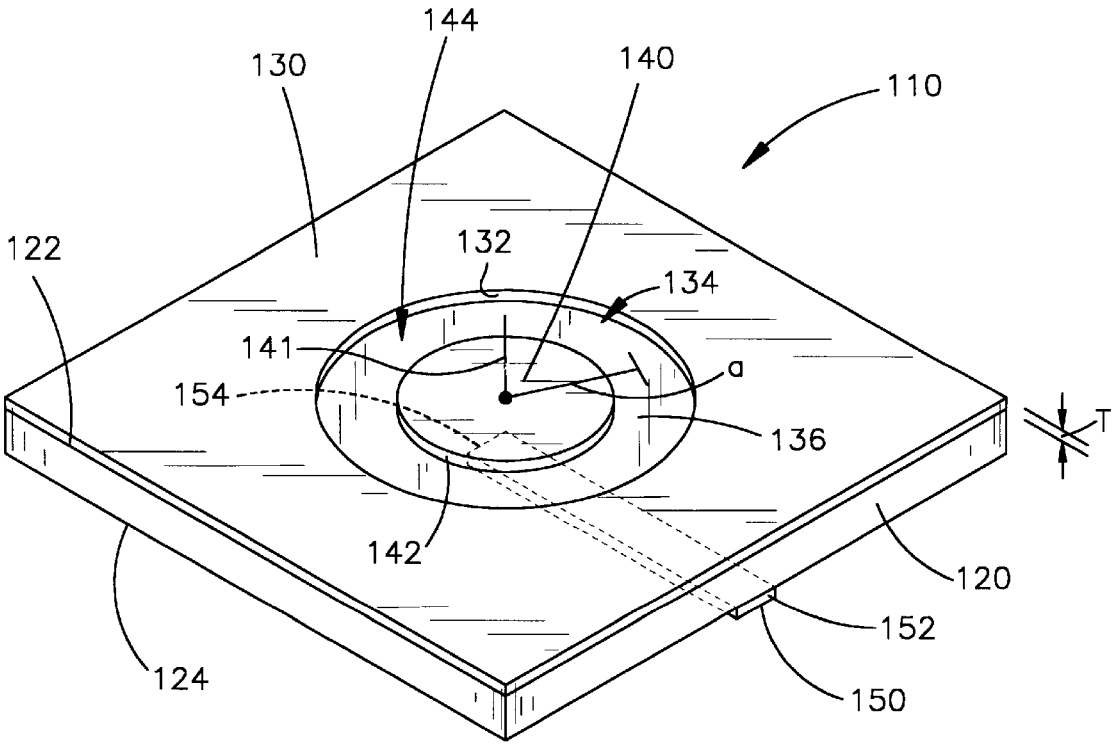
FIG. 2 is a perspective view similar to FIG. 1, illustrating a second embodiment of the present invention.

FIG. 2 illustrates a slot antenna 110 constructed in accordance with a second preferred embodiment of the present invention. The antenna 110 is capable of transmitting or receiving high frequency signals, such as a microwave frequency above about 3,000 MHz, to or from a free space. The antenna 110 includes a dielectric substrate 120 having parallel upper and lower surfaces 122 and 124, respectively. The substrate 120 is transparent and may be made of the same material as the substrate 20 of antenna 10. The antenna 110 has a ground layer 130 adhered to the upper surface 122 of the substrate 120. The ground layer 130 thus extends along a plane that is substantially parallel and spaced apart from the plane on which the lower surface 124 of the substrate 120 extends. The ground layer 130 has a centrally disposed inner edge 132 defining a circular opening 134 in the ground layer. Thus, the ground layer 130 covers essentially all of the upper surface 122 of the substrate 120, except an open circular portion 136 which is centrally positioned on the upper surface of the substrate. The ground layer 130 has a first thickness T, which is about 1000 to about 1200 Angstroms, and preferably about 1100 Angstroms. The ground layer 130 is made of an optically transparent and electrically conducting coating material, as described with respect to antenna 10.

The antenna 110 further includes a generally circular antenna layer 140 adhered to the circular portion 136 of the upper surface 122 of the substrate 120. The antenna layer 140 is defined by an outer circumferential edge 142. The antenna layer 140 is disposed radially inward a predetermined distance from the inner edge 132 of the ground layer 130 in the generally circular opening 134 of the ground layer 130. The antenna layer 140 has a thickness approximately equal to the first thickness T and is thus substantially coplanar with the ground layer 130. The antenna layer 140 is made of an electrically conducting and optically transparent coating material and is preferably made of the same material as the ground layer 130.

By positioning the ground layer 130 and the antenna layer 140 as set forth herein, an annular space or slot 144 is formed between the ground layer 130 and the antenna layer 140. The annular slot 144 is defined by the upper surface 122 of substrate 120, the inner edge 132 of ground layer 130 and the outer edge 142 of antenna layer 140. The annular slot 144 provides a free space between the ground layer 130 and the antenna layer 140. During operation of the antenna 110 in the fundamental mode, preferably $$ka=1,$$

where the wave number $k=2\pi/\lambda$, where a is the average slot radius, as measured from slot central axis 141 shown in FIG. 2, and where $\lambda$ is the free space wavelength. This mode radiates with a maximum gain in a direction normal to the plane of the slot 144.

It should be appreciated that the shape of the antenna layer 140 and the slot 144 could vary from that shown in FIG. 2. For instance, the antenna layer 140 could be square, rectangular or elliptical with the slot 144 having a corresponding shape and size. Moreover, the antenna layer 140 could instead be in the form of a straight slot (not shown)or a folded slot (not shown), all of which antenna shapes are known in the art.

The embodiment of FIG. 2 also illustrates a generally narrow and elongated feed layer 150 having first and second ends 152 and 154, respectively, adhered to the lower surface 124 of the substrate 120. First end 152 is positioned adjacent to an edge of the lower surface 124 of the substrate 120, with the second end 154 extending transversely from such substrate edge to a position approximately beneath the central axis 141. The feed layer 150 is made of an electrically conducting optically transparent coating material and is preferably made of the same material as the ground and antenna layers 130 and 140, respectively. The feed layer 150 has a thickness approximately equal to the first thickness T, such that the ground layer 130, the antenna layer 140 and the feed layer 150 are all about the same thickness.

The feed layer 150 communicates electromagnetic energy, via an electromagnetic coupling consistent with Maxwell's equations, including Faraday's Law of Induction, to or from the antenna layer 140. It should be understood that the feed layer 150 could instead be directly coupled to the antenna layer 140 in a manner similar to that shown and described with respect to FIG. 1.

The antenna 110 is manufactured in a similar manner as described above in the first embodiment. More particularly, a layer of an appropriate electrically conducting and optically transparent coating material of substantially uniform thickness is deposited on predetermined portions of the upper surface 122 of substrate 120, with a generally annular slot 144. A layer of conventional photoresist may be applied to the upper surface 122 of the substrate 120, except for the portions to be covered by the antenna layer 140 and the ground layer 130. Similarly, photoresist may be applied to the lower surface 124, except for the area to where narrow feed layer 150 is to be applied. A layer of the electrically conducting and optically transparent coating material of substantially uniform thickness is adhered to a predetermined portion of the lower surface 124 of the substrate 20 that is not covered by photoresist, preferably extending from an edge of substrate 120 to a position substantially beneath antenna layer 140. In order to complete manufacture of the antenna 10, the photoresist is removed by any conventional technique, such as by submersing the substrate 20 in a conventional liquid photoresist remover. It will be apparent that such method of manufacture enables a relatively cost effective and simple application of the coating material layers.

Figure 3:
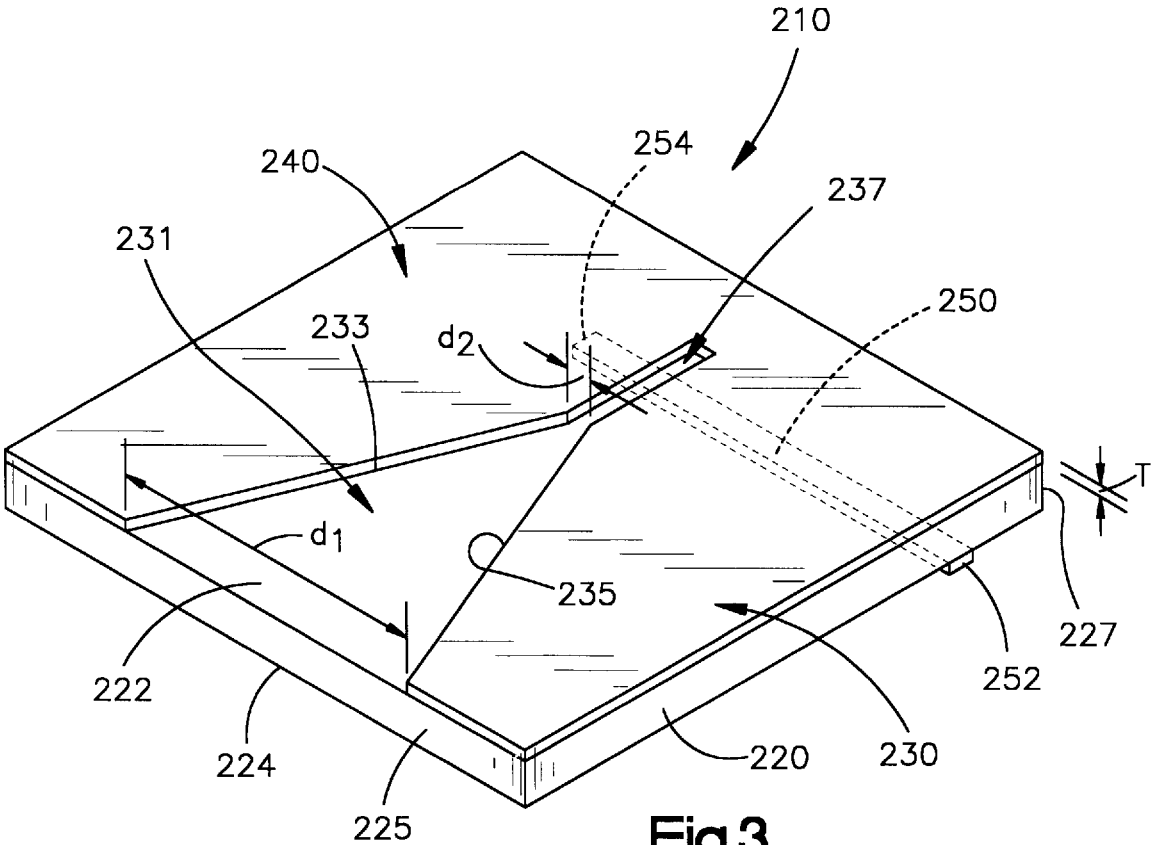
FIG. 3 is a perspective view similar to FIG. 1, illustrating a third embodiment of the present invention.

FIG. 3 illustrates a slot antenna 210 constructed in accordance with a third embodiment of the present invention. Antenna 210, like the other embodiments, is capable of transmitting or receiving high frequency signals, suitably in the microwave range or about 3000 Mhz or higher. Antenna 210 includes a dielectric substrate 220 formed of a material substantially the same as that described with respect to FIGS. 1 and 2. Substrate 220 includes an upper surface 222, a lower surface 224 substantially parallel to upper surface 222, and at least a pair of opposed side edges 225 and 227. The dielectric substrate 220 is interposed between a layer of an optically transparent and electrically conducting coating material, which defines a ground layer 230 and an antenna layer 240, and a feed element 250. Ground layer 230 is substantially coplanar with the antenna layer 240, with both having approximately the same thickness T, suitably about 1000 to about 1200 Angstroms. Preferably, ground layer 230 is coupled to antenna layer 240, such as by a direct or integral connection by the optically transparent and electrically conducting coating material on substrate upper surface 222. Of course, another optically transparent and electrically conducting material, suitably a metal, might be used to couple the antenna and ground layers 240 and 230, respectively.

The embodiment of FIG. 3 is characterized by a tapered slot, generally indicated as 231, disposed between a substantial portion of the antenna and ground layers 240 and 230, respectively. More particularly, the tapered slot 231 is formed between the ground layer 230 and the antenna layer 240 along the upper surface 222 of substrate 220, with the slot 231 having two opposed side edges 233 and 235 tapering from a first spaced apart distance $d_1$ at substrate first edge 225 to a second spaced apart distance $d_2$ at a position distal from said substrate first edge 225. Slot 231 further includes a base portion 237, with slot side edges 233 and 235 being substantially parallel and spaced apart distance $d_2$ in base portion 237. Base portion 237 extends from the tapering side edges to a position proximal the substrate second edge 227, with ground layer 230 being coupled to antenna layer 240 between base portion 237 and substrate second edge 227. As shown in FIG. 3, slot 237 defines a generally Y-shaped slot intermediate ground layer 230 and antenna layer 240. Similar to the embodiment of FIG. 2, slot 231 provides free space between ground layer 230 and antenna layer 240.

Preferably, feed element 250 is an elongated feed element having first and second ends 252 and 254, respectively, and is a layer or strip, attached to the lower substrate surface 224 extending transverse to the slot base portion 237. Feed layer 250 is formed of an optically transparent and electrically conducting material and is preferably the same coating material as the antenna and ground layers 240 and 230, respectively. Feed layer 250 also preferably has approximately the same thickness T as antenna layer 240 and ground layer 230. It will be appreciated that alternative configurations of feed layers, such as those described with the other embodiments, also may be used with equal facility. In addition, the particular dimensions of slot 231 may vary depending on the particular application.

The antenna of FIG. 3 may be manufactured in substantially the same manner as the other embodiments, suitably by lithography. Of course, it will be understood that the photoresist material should be applied to the upper and lower surfaces 222 and 224, respectively, of substrate 220, except for those areas to where the ground layer 230, antenna layer 240 and feed element 250 are to be formed. Accordingly, photoresist material will be deposited on upper surface 222 in accordance with the desired shape and dimensions of slot 231. Similarly, photoresist material should be applied to the entire lower surface 224, except where feed element 250 is to be deposited.

For simplicity of illustration, a single antenna layer has been described for each embodiment. It will be apparent to those skilled in the art that, to enhance antenna performance, the apparatus and method of the present invention may be utilized to form an antenna having a plurality of antenna layers, suitably in the form of a linear or planar array. Where such a plurality of antenna layers are formed, a common feed element may be used to excite several antenna layers.

From the above description of the invention, which is to be illustrative and not limiting, those skilled in the art will perceive improvements, changes and modifications. Such improvements, changes and modifications within the skill in the art are intended to be covered by the appended claims.

Having described the invention, the following is claimed:

1. An antenna comprising:

a ground layer;

a feed element;

an antenna layer, an electromagnetic field being produced between said ground layer and said antenna layer when said feed element and said ground layer are exposed to a microwave frequency above about 3,000 megahertz for transmission and when said antenna and ground layers are exposed to a microwave frequency above about 3,000 megahertz, for reception;

a substantially optically transparent dielectric substrate interposed between at least two of said ground layer, said antenna layer and said feed element;

said ground layer and antenna layer being made of a substantially optically transparent and electrically conducting material; and said antenna passing at least about 30% of the visible light impinging on the antenna.

2. The antenna of claim 1 wherein said feed element comprises a feed layer of a substantially optically transparent and electrically conducting material.

3. The antenna of claim 2 wherein said layers have a surface resistance equal to about 5 ohms/square or less.

4. The antenna of claim 3 wherein said layers are made of an optically transparent and electrically conducting coating material.

5. The antenna of claim 4 wherein said optically transparent and electrically conducting coating material is selected from the group consisting of indium tin oxide, cadmium tin oxide and zinc oxide.

6. The antenna of claim 5 wherein said dielectric substrate is interposed between said ground layer and said antenna layer.

7. The antenna of claim 6 wherein said feed layer is substantially coplanar with said antenna layer and extends from an edge of said dielectric substrate to a edge of said antenna layer.

8. The antenna of claim 7 wherein said antenna layer has a length of about 0.5 or less of one wavelength of a carrier signal in said substrate and a width less than or greater than or equal to said length of said antenna layer.

9. The antenna of claim 7 wherein said feed layer further comprises first and second ends, said feed layer first end positioned adjacent said edge of said dielectric material and said feed layer second end extending to a position within said antenna layer to define a portion of said feed layer inset within said antenna layer.

10. The antenna of claim 9 further comprising first and second spaced apart channels formed in said antenna layer along said inset portion of said feed layer.

11. The antenna of claim 7 wherein said layers all have substantially the same thickness.

12. The antenna of claim 2 wherein said dielectric substrate is interposed between said feed layer and said antenna layer.

13. The antenna of claim 12 wherein said antenna layer is substantially coplanar with said ground layer.

14. The antenna of claim 13 wherein said antenna layer has an outer edge, with said ground layer having an inner edge spaced from said outer edge of said antenna layer, said inner edge of said ground layer and said outer edge of said antenna layer helping to define a free space between said antenna layer and said ground layer.

15. The antenna of claim 1 wherein said ground and antenna layers are on one side of said substrate and said feed element is on the other side of said substrate, said antenna further comprising a tapered slot formed between said ground layer and said antenna layer along said one side of said substrate, said slot having two opposed side edges tapering from a first spaced apart distance at a first edge of said substrate to a second spaced apart distance at a position distal from said substrate first edge.

16. The antenna of claim 15 wherein said slot further comprises a base portion having side edges spaced apart said second spaced apart distance and extending from said side edges at said distal position to a position proximal a second edge of said substrate opposite said substrate first edge, said slot defining a generally Y-shaped slot.

17. The antenna of claim 16 wherein said ground layer is coupled to and substantially coplanar with said antenna layer.

18. The antenna of claim 16 wherein said feed element further comprises an elongated feed element attached to said other side of said substrate opposite said antenna and ground layers, said elongated feed element extending transverse to said slot base portion.

19. The antenna of claim 18 wherein said elongated feed element comprises a feed layer of an optically transparent and electrically conducting coating material.

20. A method for making a substantially optically transparent and electrically conducting antenna, said method comprising the steps of:

providing a sheet of substantially optically transparent dielectric substrate having a first surface and a second surface;

depositing a first layer of substantially optically transparent and electrically conducting coating material to at least a substantial portion of said second surface;

depositing a second layer of substantially optically transparent and electrically conducting coating material to a portion of at least one of said first and second surfaces of said substrate;

attaching a feed element to said first surface of said substrate, such that an electromagnetic field is produced between said first layer and said second layer when said feed element and said first layer are exposed to a microwave frequency above about 3,000 megahertz for transmission and when said first layer and said second layer are exposed to a microwave frequency above about 3,000 megahertz, for reception.

* * * * *